US005527995A

United States Patent [19]

Lasky

[11] Patent Number: 5,527,995

[45] Date of Patent: Jun. 18, 1996

[54] CABLE FOR CONDUCTING ENERGY

[75] Inventor: Jack S. Lasky, Verona, N.J.

[73] Assignee: The Okonite Company, Ramsey, N.J.

[21] Appl. No.: 285,647

[22] Filed: Aug. 3, 1994

[51] Int. Cl.[6] ..... H01B 9/02

[52] U.S. Cl. ..... 174/102 SC; 174/102 D; 174/106 D; 174/107

[58] Field of Search ..... 174/102 SC, 102 D, 174/107, 106 D, 102 R

[56] References Cited

U.S. PATENT DOCUMENTS

| | | | |
|---|---|---|---|
| Re. 30,228 | 3/1980 | Silver et al. | 174/36 |
| 2,870,792 | 1/1959 | Penrose . | |
| 3,582,536 | 6/1971 | Miller | 174/102 R |
| 3,617,377 | 11/1971 | Isshiki | 174/107 |
| 3,745,232 | 7/1973 | Johnson et al. | 174/107 |
| 4,151,365 | 4/1979 | Hacker | 174/107 |
| 4,284,842 | 8/1981 | Arroyo et al. | 174/107 |
| 4,328,394 | 5/1982 | Aloisio, Jr. et al. | 174/106 D |
| 4,749,823 | 6/1988 | Ziemek et al. | 174/103 |
| 4,780,574 | 10/1988 | Neuroth | 174/102 D |
| 5,153,381 | 10/1992 | Ganatra et al. | 174/102 R |
| 5,307,416 | 4/1994 | Martin | 381/77 |
| 5,389,736 | 2/1995 | Ziemek et al. | 174/36 |

FOREIGN PATENT DOCUMENTS

| | | | |
|---|---|---|---|
| 166203 | 12/1955 | Australia | 174/102 D |
| 452410 | 11/1948 | Canada | 174/102 D |
| 2151391 | 7/1985 | United Kingdom | 174/102 D |

*Primary Examiner*—Morris H. Nimmo

*Attorney, Agent, or Firm*—Hopgood, Calimafde, Kalil & Judlowe

[57] ABSTRACT

This invention relates to an energy conducting cable assembly. In accordance with one aspect of the present invention, the assembly comprises a conductor covered by at least one layer of insulation, and a longitudinally welded corrugated brass sheath formed about the insulation so as to effect a hermetic seal about the conductor. The cable has an ampacity and fault carrying capacity which approximates that of a cable having a like diameter sheath of chemical lead. The sheath preferably has a corrugation pitch to corrugation depth ratio of less than about 3.75 and an outside sheath diameter to sheath wall thickness ratio of greater than about 100.

19 Claims, 2 Drawing Sheets

CABLE FOR CONDUCTING ENERGY

DISCLOSURE OF THE INVENTION

The present invention relates generally to conductors for the transmission and distribution of electrical energy and more particularly to a novel construction for power cables.

Wire conductors are used as the core of conventional underground power cables. Typically, these wires are bunched together, covered with semiconducting and insulating materials, and encased in a protective sheath. An objective is to protect the conductors and insulation from the ingress of moisture, while offering strength, durability and flexibility suitable for underground environments.

Historically, lead was the material of choice. As a result, lead sheaths are commonly found over insulated wire conductors having, for example, paper/oil insulation and solid dielectrics such as ethylene-propylene rubber or cross linked polyethylene. Lead provides flexibility, hermetic sealing capability, and is considered relatively easy to extrude into long lengths.

It has been found, however, that lead sheaths have a tendency toward intercrystalline fatigue cracking, and often deform upon bending. In addition, concern over their cost, weight and possible health effects has made them generally undesirable.

More contemporary sheath materials include polyethylene, polyvinyl chloride, and thin metal-plastic laminates. For improved moisture resistance, interstices of multiconductor cable cores are often filled with moisture absorbing powders or petrolatum like materials. While polymeric sheaths have offered a relatively light, high strength and low cost alternative to lead, they do not fully prevent the penetration of moisture and other environmental contaminants which may damage conductors and their insulation. They are also considered lacking in strength to protect the core against impact and the like. Thin metal plastic laminates have similarly been found less desirable. For instance, upon wrapping these laminates about the cable, they are overlapped rather than welded, leaving a seam for the ingress of moisture. In addition, the thin metal component of the laminate is incapable of carrying fault or circulating currents.

Welded corrugated copper (or aluminum) envelopes also afford cable protection. These envelopes are relatively light, provide hermetic sealing capability and crush resistance, and serve as a neutral conductor when placed over power cables. It has been found, however, that as result of their relatively high conductivity, substantial currents are induced in the metallic sheath which reduce the current carrying capacity (or ampacity) of power cables. Moreover, conventional corrugation configurations needed to maintain a low weight, but mechanically sound sheath required a substantially larger cable diameter than would fit conduits of conventional underground power distribution systems.

A non-toxic, non-polluting metallic sheath is therefore desired which can hermetically seal an insulated conductor, with an electrical resistance comparable to that of smooth lead sheaths. Crush resistance, flexibility, low cost and weight are also desired, but at a size suitable for fitting the standard sized conduits of existing power distribution systems.

Accordingly, it is an object of the present invention to provide a strong, safe, lightweight sheath for energy conducting cables which is not only durable and reliable, but also provides stability, cross sectional rigidity, flexibility and a desirable conductivity.

Another object of the present invention is to provide an economical metallic sheath material with a thickness that would provide suitable mechanical integrity and weldability, while closely matching the resistivity and diameter of lead sheaths.

In accordance with one aspect of the present invention, there is provided a specific, illustrative energy conducting cable assembly. The assembly comprises a conductor with at least one layer of insulation, and a corrugated sheath of brass (90/10 copper/zinc, Alloy C22000) formed about the insulation so as to effect a hermetic seal about the insulated conductor. The sheath preferably has a corrugation pitch to corrugation depth ratio of less than about 3.75 and an outside sheath diameter to sheath wall thickness ratio of greater than about 100.

The above and other features and advantages of the present invention are realized in specific, illustrative embodiments thereof, presented hereinbelow in conjunction with the accompanying drawings, in which.

The same numerals are used throughout the various figures of the drawings to designate similar parts.

Still other objects and advantages of the present invention will become apparent from the following description of the preferred embodiments.

Figure 1:
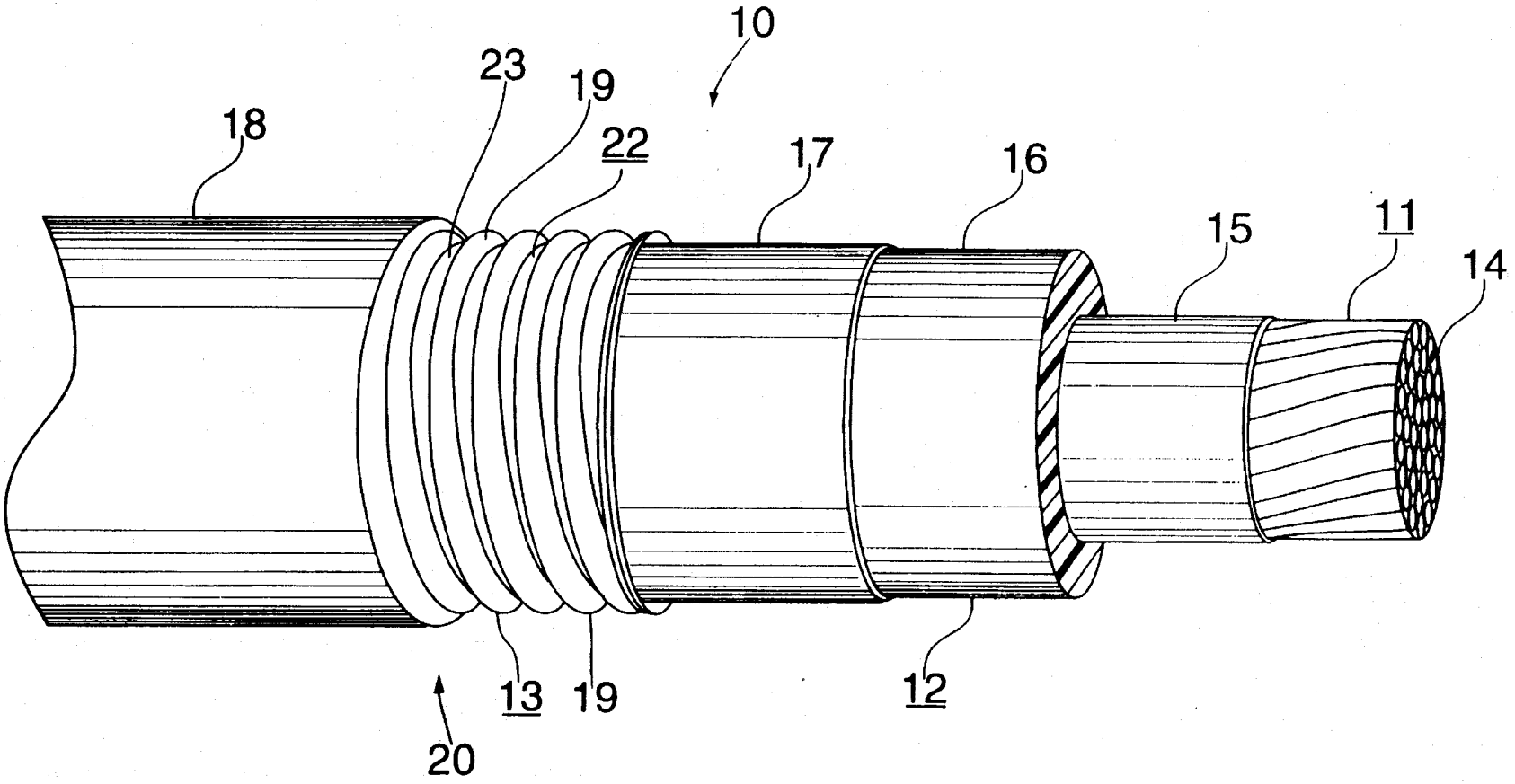
FIG. 1 is a cut-away perspective view of a power cable assembly in accordance with one aspect of the present invention.
Figure 2:
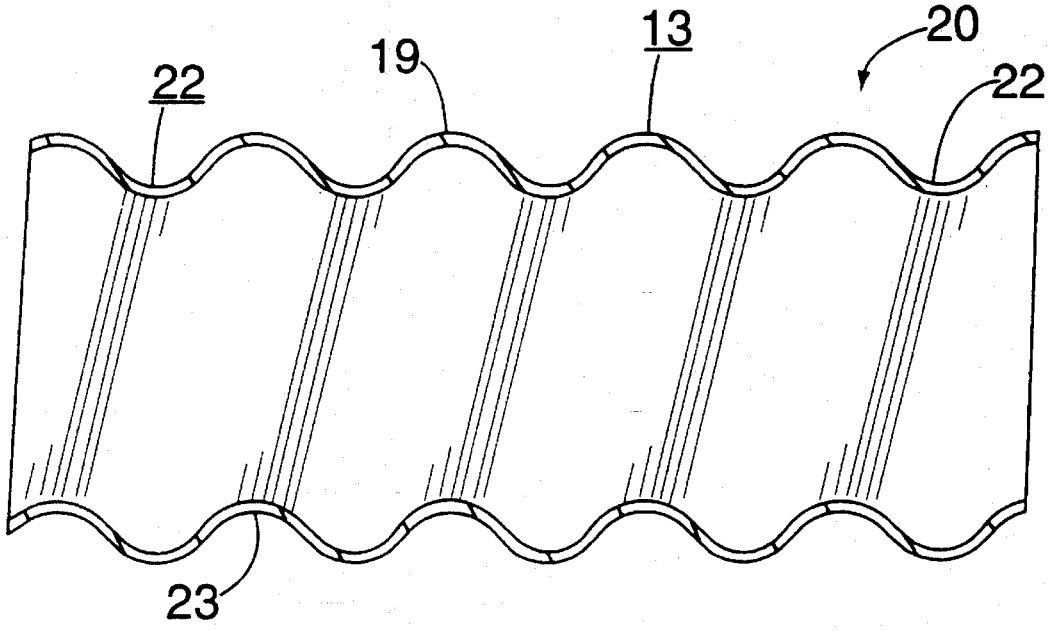
FIG. 2 is a side view of a corrugated sheath for the assembly of FIG. 1.
Figure 3:
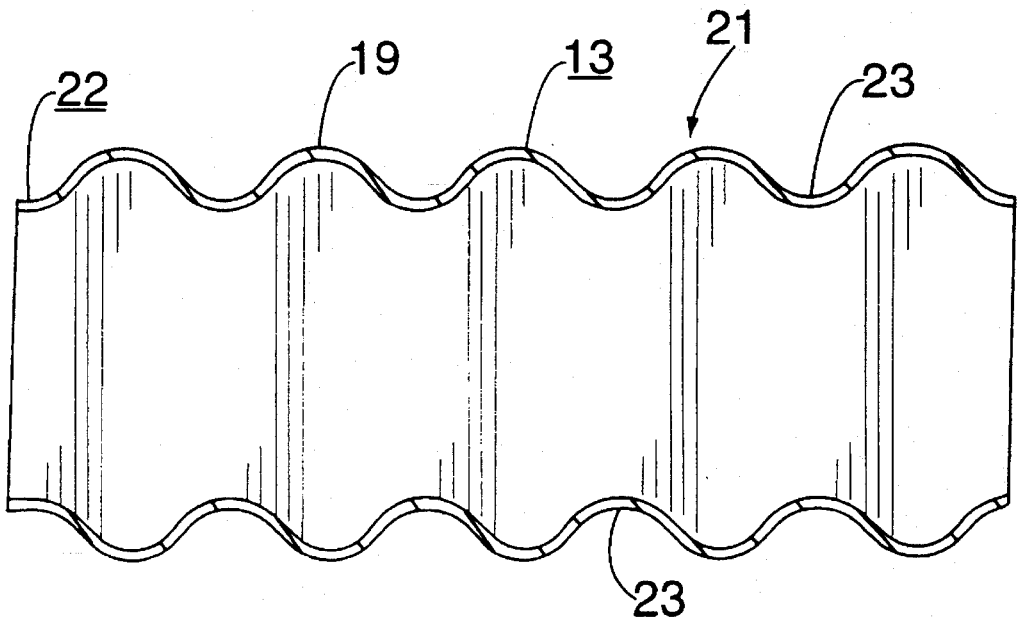
FIG. 3 is a side view of a corrugated sheath for a power cable assembly, in accordance with another aspect of the present invention.

Referring now to the drawings and more particularly to FIGS. 1–3 there is shown generally a specific, illustrative energy conducting cable assembly 10 in accordance with various aspects of the present invention.

The present invention is particularly advantageous in its use of a novel corrugated sheath construction. This construction provides desirable strength and bending characteristics when compared to those of conventional sheaths, and at the same or substantially lower material thicknesses.

In accordance with one aspect of the present invention, the assembly comprises a conductor 11 of electrical energy covered by at least one layer of insulation 12. A longitudinally welded corrugated metallic sheath 13 is formed about the insulation so as to effect a hermetic seal about the insulated conductor and provide strength and flexibility. The sheath preferably has a corrugation pitch to corrugation depth ratio of less than about 3.75 and an outside sheath diameter to sheath wall thickness ratio of greater than about 100.

Conductor 11 is typically formed of a twisted plurality of wires 14 surrounded by several insulating and/or protective layers. Each wire is preferably made of commercially pure copper. Alternatively or concurrently therewith, the conductor comprises aluminum or an aluminum alloy.

First layer 15 of the assembly is a semiconducting screen. This layer comprises a relatively thin semiconducting polymer compound, e.g., ethylene propylene rubber compounded with a conductive carbon black. Electrical insulation, e.g., an ethylene propylene rubber based insulation, is provided by a second layer 16 of the assembly. A third layer 17 comprises another semiconducting screen, also a relatively thin semiconducting polymer compound. Sheath 13 forms a fourth, tight fitting welded and corrugated envelope, a purpose of which is to effect a hermetic seal. Sheath 13 is made up of a series of alternating crests 19 and troughs 23.

Optionally, a compressible buffer layer, e.g., semiconducting tape, is placed between sheath 13 and layer 17 to cushion the thermal expansion of the core as its temperature increases and to prevent deformation of the insulated core due to the relatively tight fit of the metallic sheath. Alternatively, compressible, semiconducting, longitudinally raised ridges, e.g., 0.4–1.0 mm in height, are extruded into semiconducting layer 17 so as to form an integral portion thereof.

In this manner, the metallic sheath is formed in such a fashion that the troughs of the corrugations grip the cable firmly, but without causing indentations in the cable core. This prevents the core from slipping inside the metallic sheath.

Another option is shown in FIG. 1 where a fifth layer 18, e.g., a polymeric jacket such as polyvinyl chloride, is placed over the sheath. This may be done for added protection from the surrounding environment, i.e., to prevent sheath puncture or abrasion. In general, the necessity of the fifth layer varies depending upon intended use and environment, as will be understood by those skilled in the art.

In an alternative embodiment, the semiconducting layers are omitted. The conductor is covered by insulation layer 16 and sheath 13. A polymeric jacket may also be placed over the sheath.

Alloy C22000 (otherwise known as brass or commercial bronze) has been found particularly advantageous as a material for use in corrugated sheaths for power cable applications. This alloy is relatively light and provides desirable levels of conductivity as compared to lead and other conventional sheath materials. Moreover, brass has been found strong enough to withstand forces experienced in underground environments, durable over time, and less costly than prior sheath materials.

Preferably, the brass used is commercial bronze. Commercial bronze consists of copper generally within a range of 89.0 to 91.0%, a maximum of about 0.05% lead and about 0.05% iron, the balance zinc.

Although the present invention is shown and described as using commercial bronze, it will be understood that other materials, e.g., other alloys of copper, may be used in conjunction with the novel corrugation pattern set forth herein, without departing from the spirit and scope of the present invention.

The strength of a cable sheath is determined, in part, by its thickness. In accordance with the present invention, sheath thickness is set preferably by matching the ampacity of the cable to that using the relatively thicker (and heavier) lead sheath. As best seen in FIGS. 2 and 3, sheath 13 is relatively thin, e.g., about 0.4 mm thick. This is made possible by the relatively high stiffness to mass ratio or specific modulus of brass and the choice of a suitable corrugation configuration.

As for the relative lightness of corrugated brass sheaths, it is a function both of sheath thickness and material density. For instance, the density of brass is about 8.80 g/cm$^3$ at 20° C.(68° F.), whereas chemical lead (UNS L51120 containing 99.90% lead) has a density on the order of 11.35 g/cm$^3$. The density (and weight) of brass being substantially lower than that of lead, as well as its greater strength and durability, more than offsets its slightly reduced formability as compared to lead.

By minimizing cable weight, energy required to lift and lay power cables is decreased. This reduces installation time, lowering costs.

Another advantage of the present invention is its ability to carry short circuit currents and limit circulating currents which may be induced in the corrugated sheaths as energy travels along the conductors. One way this is done is by using a material of suitable electrical resistivity. Another objective is to provide a path for ground and fault currents. Commercial bronze, 90Cu/10Zn, for example, at 20° C.(68° F.) annealed, has an electrical conductivity of about 44% IACS and an electrical resistivity on the order of 23.8 circular mil-ohm/ft at 20° C.(68° F.), which is desirable. Chemical lead, on the other hand, at 20° C.(68° F.) has a conductivity of about 7.84% IACS and an electrical resistivity of about 132.3 circular mil-ohm/ft.

A corrugated brass sheathed cable, in accordance with the present invention, has an ampacity equivalent to that of a conventional lead sheath cable generally having the same diameter. For example, a cable with a lead sheath 0.0950 inch thick has an ampacity of 548.27 amps. A brass sheath on the same cable core is then 0.0150 inch thick and has an ampacity of 543.88 amps.

It is understood, however, that at a substantially lower resistance, cable ampacity would be reduced due to induced currents in the sheath. The total amperes carried by the conductor is typically limited by the temperature rating of the insulation. The higher the current, the higher the conductor temperature and thus the higher the temperature of the overlying insulation.

To maintain a suitable cable diameter at a selected sheath thickness, while preserving mechanical integrity during bending, it has been found generally that the number of corrugations per unit of sheath length must be increased, and that troughs 23 between the crests must be made more shallow. By forming brass into a corrugated shape, as set forth by the present invention, its strength gets closer to or exceeds that of other sheath materials, but at a substantially reduced conductivity and weight. However, those skilled in the art will recognize that other copper alloys could be used for this purpose, and that differences in strength as compared to brass may be accommodated by means other than (or in addition to) corrugations.

This increase in the number of corrugations has another benefit. It increases DC electrical resistance ($R_{DC}$), thereby decreasing circulating currents further. Accordingly, the relatively lower resistivity of brass (and relatively lower sheath thickness) at a given strength as compared to lead is offset by the relative increase in the number of corrugations. Given the relationship DC electrical resistance or $R_{DC}$= electrical resistivity/sheath cross sectional area A, a 15 mil thick brass sheath having a conductivity of 44% IACS at 20° C. is then approximately 85% equivalent in resistance to that of a 95 mil thick lead sheath.

Although the present invention is shown and described as using brass, the suitability of other sheath metals having an electrical conductivity within a range of about 20 to 60% IACS is understood, giving consideration to other desired sheath characteristics and the various objectives of the present invention.

A further benefit is the invention's improved minimum bending radii as compared to lead sheaths. This means that the present cable assembly has a greater capacity to be bent while maintaining safe electrical operation and without danger of physical damage to insulation or coverings. In accordance with one aspect of the present invention, the minimum bending radius as a multiple of the outside diameter $D_{outer}$ of the corrugated sheath is $7 \cdot D_{outer}$. This provides greater adaptability and therefore a larger variety of cable uses.

To achieve wall thickness (and weight) reduction of the metallic sheath without sacrificing mechanical strength requires selected dimensional ratios. First, the inside diameter $D_{inner}$ of the corrugated tube must be between about 75% and about 85% of its outside diameter $D_{outside}$. Second, the pitch of the sheath corrugations must be between about 15% and about 25% of the outside diameter $D_{outside}$. Third, the wall thickness t must be between about 0.5% and about 2.0% of the outer diameter $D_{outside}$. Wall thickness t of the sheath in smooth tube form, i.e., prior to corrugating, is computed by the expression $t=\frac{1}{2}(D_{outer}-D_{inner})$. It is noted that the increase in diameter of the sheathed cable over the core diameter, which is due to the corrugations, is preferably within a range of about 100 and 200 mils.

This means that the corrugation pitch (or distance between adjacent crests) to corrugation depth ratio must be less than about 3.75 and the outside sheath diameter to sheath wall thickness ratio must be greater than about 100. Conventional ratios are significantly less.

The following is exemplary of a corrugated cable sheath, in accordance with one aspect of the present invention.

| | |
|---|---|
| Outside diameter (D) | 41.0 mm |
| Inside diameter (d) (diameter of cable core) | 36.4 mm |
| Wall thickness (t) | 0.4 mm |
| Depth of corrugation (s) | 1.9 mm |
| Corrugation pitch (T) (pitch between two corrugation peaks) | 5.4 mm |
| D/t ratio | 102.50 |
| T/s ratio | 2.84 |

To form a corrugated brass sheath, in accordance with the present invention, an insulated conductor core, e.g., an ethylene propylene rubber based insulated conductor, is placed centrally on a relatively flat strip of brass. A machine forms the strip longitudinally around the core such that side edges of the strip abut one another. The strip edges are then welded together, thereby forming a relatively smooth brass tube. The welded seam has a width, e.g., of less than about 1.5 mm and the heat effected zone has a width, e.g., of less than about 1 cm. Finally, corrugations are formed in the sheath to such an extent that the grooves grip the core. The number of corrugations is preferably within a range of about 4 and 7 corrugations per linear inch.

In accordance with various aspects of the present invention, cable corrugations 19 may be formed in a helical 20 or ring-shaped 21 configuration, as will be understood by those skilled in the art. Hence, the corrugations may be helical or annular. Sheath roundness has been found relatively important to commercial applications since cable assemblies are often placed inside pipes.

The novel corrugation form of the present invention, by reducing corrugation depth and pitch, increases sheath stability and resistance to indentation. Forces acting on the sheath are distributed over many, closely spaced crests, maintaining stability and resistance to indentation even under extreme and adverse conditions. Moreover, brass sheaths are entirely impervious to moisture, unlike polymers, while being cost competitive with lead.

Although the present invention has been shown and described for use in power distribution cables, particularly those utilized in underground environments, its application to other energy conducting uses and its placement in other environments will be appreciated by those skilled in the art, giving consideration to the purpose for which it is intended. For example, the cable sheath may be adapted for power transmission or control cable systems. Also, the hermetic seal provided lends suitability to underwater environments without departing from the spirit and scope of the present invention. The sheath is advantageous in effecting a protective barrier from the environment, and providing mechanical protection during cable handling and installation.

While the present invention has, in addition, been shown and described with reference to lead, the stated advantages may hold true for other sheath materials and configurations, as will be understood by those skilled in the art.

Since from the foregoing the construction and advantages of the invention may be readily understood, further explanation is believed unnecessary. However, since numerous modifications will readily occur to those skilled in the art after consideration of the foregoing specification and accompanying drawings, it is not intended that the invention be limited to the exact construction shown and described, but all suitable modifications and equivalents may be resorted to which fall within the scope of the appended claims.

What is claimed is:

1. An energy conducting cable, which comprises:

at least one metallic conductor, the conductor having a first layer of semiconducting material, a second layer of insulating material, and a third layer of semiconducting material; and a longitudinally welded corrugated metallic sheath housing said conductor core, the cable having an ampacity and fault carrying capacity which approximates that of a cable having a like diameter sheath of chemical lead;

the sheath consisting essentially of brass, having a corrugation pitch to corrugation depth ratio of less than about 3.75, and an outside sheath diameter to sheath wall thickness ratio of greater than about 100.

2. The cable set forth in claim 1 wherein at least one conductor consists of commercially pure copper.

3. The cable set forth in claim 1 wherein at least one conductor consists of aluminum.

4. The cable set forth in claim 1 wherein at least one conductor consists of an aluminum alloy.

5. An energy conducting cable, which comprises:

at least one metallic conductor at its core covered by at least one layer of insulating material; and a longitudinally welded corrugated metallic sheath housing said conductor core; the cable having an ampacity and fault carrying capacity which approximates that of a cable having a like diameter sheath of chemical lead;

the sheath having a resistivity generally within a range of 20–60% IACS, consisting essentially of brass, and forming a hermetic seal about the cable, the corrugation pitch to corrugation depth ratio being less than about 3.75 and the outside sheath diameter to sheath wall thickness ratio being greater than about 100.

6. The cable set forth in claim 5 wherein a polymeric material surrounds substantially the sheath.

7. The cable set forth in claim 5, wherein at least one conductor consists of commercially pure copper.

8. The cable set forth in claim 5 wherein at least one conductor consists of aluminum.

9. The cable set forth in claim 5 wherein at least one conductor consists of an aluminum alloy.

10. The cable set forth in claim 5 wherein at least one insulating layer and at least two semiconducting layers are between the conductor and the sheath.

11. An energy conducting cable, which comprises:

at least one metallic conductor at its core covered by at least one layer of insulating material; and a longitudinally welded corrugated metallic sheath housing said conductor core, the cable having an ampacity and fault carrying capacity which approximates that of a cable having a like diameter sheath of chemical lead;

the sheath consisting essentially of brass and forming a hermetic seal about the cable, the corrugation pitch to corrugation depth ratio being less than about 3.75.

12. The corrugated sheath set forth in claim 11 wherein the outside sheath diameter to sheath wall thickness ratio is greater than about 100.

13. An energy conducting cable, which comprises:

at least one metallic conductor, the conductor having a first layer of semiconducting material, a second layer of insulating material, and a third layer of semiconducting material, and a longitudinally welded corrugated metallic sheath housing said conductor core, the cable having an ampacity and fault carrying capacity which approximates that of a cable having a like diameter sheath of chemical lead;

the sheath consisting essentially of brass and forming a hermetic seal about the cable, the corrugation pitch to corrugation depth ratio being less than about 3.75;

the sheath further having an inside diameter generally within a range of 75% and 85% of the sheath outside diameter, a corrugation pitch generally within a range of 15% and 25% of the outside diameter, and a wall thickness generally within a range of 0.5% and 2.0% of the outside diameter.

14. The cable set forth in claim 13 wherein the outside sheath diameter to sheath wall thickness ratio is greater than about 100.

15. The cable set forth in claim 13 wherein the corrugation pitch to corrugation depth ratio is less than about 3.75 and the outside sheath diameter to sheath wall thickness ratio is greater than about 100.

16. The cable set forth in claim 13 wherein a cushioning layer is located between the sheath and cable core.

17. The cable set forth in claim 13 wherein semiconducting longitudinal ridges are extruded as an integral portion of the outer semiconducting layer.

18. The cable set forth in claim 13 wherein the number of corrugations is generally within the range of 4 and 7 per linear inch.

19. An energy conducting cable, which comprises:

at least one metallic conductor, the conductor having a first layer of semiconducting material, a second layer of insulating material, and a third layer of semiconducting material; and a longitudinally welded corrugated metallic sheath housing said conductor core, the cable having an ampacity and fault carrying capacity which approximates that of a cable having a like diameter sheath of chemical lead;

the sheath forming a hermetic seal about the cable and the metal being formable into strips and weldable, the sheath having a corrugation depth ratio of less than about 3.75 and an outside sheath diameter to sheath wall thickness ratio of greater than about 100.

* * * * *